US011441105B2

(12) United States Patent
Hong et al.

(10) Patent No.: US 11,441,105 B2
(45) Date of Patent: Sep. 13, 2022

(54) COMPOSITION CONTAINING LANTHANIDE METAL COMPLEX

(71) Applicant: RHODIA OPERATIONS, Paris (FR)

(72) Inventors: Bing Hong, Shanghai (CN); Alexander Lerch, Gelnhausen (DE); Stéphane Streiff, Shanghai (CN); Peng Fei Ji, Shanghai (CN); Armin T. Liebens, Shanghai (CN)

(73) Assignee: Rhodia Operations

( * ) Notice: Subject to any disclaimer, the term of this patent is extended or adjusted under 35 U.S.C. 154(b) by 0 days.

(21) Appl. No.: 16/771,520

(22) PCT Filed: Dec. 15, 2017

(86) PCT No.: PCT/CN2017/116373
§ 371 (c)(1),
(2) Date: Jun. 10, 2020

(87) PCT Pub. No.: WO2019/113926
PCT Pub. Date: Jun. 20, 2019

(65) Prior Publication Data

US 2021/0179975 A1 Jun. 17, 2021

(51) Int. Cl.

| | |
|---|---|
| ***C11D 1/00*** | (2006.01) |
| ***C11D 3/20*** | (2006.01) |
| ***C11D 3/28*** | (2006.01) |
| ***C11D 3/39*** | (2006.01) |
| ***C11D 3/395*** | (2006.01) |
| ***C11D 11/00*** | (2006.01) |
| ***C11D 17/04*** | (2006.01) |
| ***C11D 3/34*** | (2006.01) |

(52) U.S. Cl.
CPC ..... *C11D 3/392* (2013.01); *C11D 1/00* (2013.01); *C11D 3/20* (2013.01); *C11D 3/28* (2013.01); *C11D 3/34* (2013.01); *C11D 3/3409* (2013.01); *C11D 3/391* (2013.01); *C11D 3/3915* (2013.01); *C11D 3/3917* (2013.01); *C11D 3/3942* (2013.01); *C11D 11/0023* (2013.01); *C11D 17/049* (2013.01)

(58) Field of Classification Search
CPC .... C11D 1/00; C11D 3/20; C11D 3/28; C11D 3/34; C11D 3/3409; C11D 3/3915; C11D 3/3917
USPC ..... 510/311, 314, 372, 376, 495, 500
See application file for complete search history.

(56) References Cited

U.S. PATENT DOCUMENTS

| | | | |
|---|---|---|---|
| 4,604,224 | A | 8/1986 | Cheng |
| 5,246,621 | A | 9/1993 | Favre et al. |
| 5,653,910 | A | 8/1997 | Kerschner et al. |
| 2010/0048447 | A1 | 2/2010 | Hatzelt et al. |

FOREIGN PATENT DOCUMENTS

| | | | | |
|---|---|---|---|---|
| AT | 388928 | | 2/1989 | |
| CN | 101824745 | | 9/2010 | |
| CN | 103131556 | | 6/2013 | |
| CN | 103320240 | | 9/2013 | |
| CN | 104695241 | | 6/2015 | |
| CN | 106592199 | | 4/2017 | |
| DE | 2631466 | | 2/1977 | |
| DE | 102012217062 | | 5/2014 | |
| EP | 0021491 | | 1/1981 | |
| EP | 0038591 | | 10/1981 | |
| EP | 0087035 | | 8/1983 | |
| EP | 0384070 | | 8/1990 | |
| EP | 0522726 | | 1/1993 | |
| FR | 831480 | | 9/1938 | |
| GB | 2013259 | | 8/1979 | |
| JP | 2015101577 | | 6/2015 | |
| KR | 20130025281 | | 9/2013 | |
| KR | 135845 | | 2/2014 | |
| KR | 1357225 | | 2/2014 | |
| WO | 9424251 | | 10/1994 | |
| WO | 0032731 | | 6/2000 | |
| WO | WO-0032731 | A1 * | 6/2000 | ..... C11D 3/3932 |
| WO | 02088289 | A2 | 11/2002 | |
| WO | 2004039934 | A1 | 5/2004 | |
| WO | 12159944 | | 11/2012 | |

OTHER PUBLICATIONS

English language machine translation of WO00/32731. (Year: 2000).*
Gao. et. al, Bleaching and dyeing of wool with rare earth elements, Fangzhi Xuebao (1985), 6(3), 168-9.
Petoud. et. al, Stable Lanthanide Luminescence Agents Highly Emissive in Aqueous Solution: Multidentate 2-Hydroxyisophthalamide Complexes of Sm3+, Eu3+, Tb3+, Dy3+, J. Am. Chem. Soc. 2003, 125, 44, 13324-13325.
Bartl. et. al, Synthesis and luminescence properties of mesostructured thin films activated by in-situ formed trivalent rare earth ion complexes, Chem. Commun., 2002, 2474-2475.
Surface Active Agents vol. 1, by Schwartz&Perry, Interscience 1949.
Vol. 2 by Schwartz, Perry&Berch, Interscience 1958.
McCutcheon's Emulsifiers and Detergents published by Manufacturing Confectioners Company or in "Tenside-Taschenbuch", H. Stache, 2nd Edn., Carl Hauser Verlag, 1981.
Enzyme nomenclature 1992: recommendations of the Nomenclature Committee of the International Union of Biochemistry and Molecular Biology on the nomenclature and classification of enzymes, 1992, ISBN 0-12-227165-3, Academic Press.

* cited by examiner

*Primary Examiner* — Gregory R Delcotto
(74) *Attorney, Agent, or Firm* — Jarrod N. Raphael

(57) ABSTRACT

Provided is the use of a lanthanide metal complex as a bleaching catalyst. In particular, the lanthanide metal complex comprises a ligand which is an aromatic compound having at least one electron withdrawing substituent and at least one nucleophilic group. Provided is also a composition containing the lanthanide metal complex.

15 Claims, No Drawings

COMPOSITION CONTAINING LANTHANIDE METAL COMPLEX

TECHNICAL FIELD

The present invention relates to the use of a lanthanide metal complex as a bleaching catalyst. In particular, the lanthanide metal complex comprises a ligand which is an aromatic compound having at least one electron withdrawing substituent and at least one nucleophilic group. The present invention also relates to a composition containing the lanthanide metal complex.

BACKGROUND

The following discussion of the prior art is provided to place the invention in an appropriate technical context and enable the advantages of it to be more fully understood. It should be appreciated, however, that any discussion of the prior art throughout the specification should not be considered as an express or implied admission that such prior art is widely known or forms part of common general knowledge in the field.

Peroxide bleaching agents for the use in laundering have been known for many years. Such agents are effective in removing stains, such as tea, fruit and wine stains, from fabrics.

For hydrogen peroxide to be effective for bleaching, it must be converted into an activated species which has robust bleaching activities. For example, it is possible to produce activated peroxy compounds directly from peracid precursors, or to form the activated peroxy compounds with the help of "bleaching activators". The "bleaching activators", such as tetraacetylethylenediamine (TAED), can convert hydrogen peroxide into the activated species by perhydrolysis. However, the amount of such bleaching activators used is always quite large.

It is also known to use a bleaching catalyst for producing activated species. A bleaching catalyst means a substance which is capable of improving the bleaching performance of hydrogen peroxide on a bleachable substance without itself participating stoichiometrically in the reaction. For instance, many transition metal ion catalysts can catalyze the decomposition of hydrogen peroxide, or hydrogen peroxide liberating or hydrogen peroxide generating compounds.

Hitherto, the most effective peroxide bleaching catalysts are based on transition metal, such as iron, cobalt and manganese. For example, the bleaching catalysts can be manganese-triazacyclononane complexes, manganese Schiff-Base complexes, manganese cross-bridged macrocyclic complexes, manganese complexes with 2,2':6,2"-terpyridine, iron complexes with tris(pyridin-2ylmethyl)amine (TPA), iron complexes with pentadentate nitrogen-donor ligands and cobalt complexes with polypyridineamine ligands.

Although these transition metal catalysts have been proven to improve the activities of peroxy compounds, one drawback is that when they are used for textiles, they will damage the textiles and will result in loss of tensile strength of the fibers and/or produce color damage to the textiles.

The transition metal ions are inherently instable under the alkaline conditions prevailing in normal washing operations. Transition metals tend to precipitate in alkaline detergent solutions in the form of hydroxides.

Furthermore, addition of the catalysts based on the transition metal cobalt or manganese to detergent formulations may cause concerns on environment protection perspective.

U.S. Pat. No. 5,246,621 teaches the use of a series of manganese complexes with dinuclear manganese surrounded by coordinating ligands, especially 1,4,7-trimethyl-1,4,7-triazacyclononane ($Me_3$-TACN), having oxygen bridges between the metal centers. These complexes are extremely active, even at low temperatures in catalyzing peroxy compounds. A wide variety of laundry stains are removable through these materials. However, the cost of the dinuclear manganese complex catalysts is high. On the other hand, the fabric can be easily damaged when these dinuclear manganese complexes are used.

There is a need to provide a catalyst which has high activities and which causes minimal damage to textiles. There is also a need to provide a catalyst which is more environment friendly than those comprising cobalt or manganese.

SUMMARY OF THE INVENTION

The present invention relates to a composition comprising:

a) a source of hydrogen peroxide; and b) a lanthanide metal complex comprising:

- a metal selected from the group consisting of La, Ce, Pr, Nd, Pm, Sm, Eu, Gd, Tb, Dy, Ho, Er, Tm, Yb and Lu, and
- an aromatic compound as a ligand, wherein the aromatic compound comprises at least one electron withdrawing substituent and at least one nucleophilic group.

It has been surprisingly found that the lanthanide metal complex according to the present invention can provide robust catalytic activities during the washing process and in the subsequent rinsing process, for catalyzing the bleaching action of the source of hydrogen peroxide.

At the same time, the lanthanide metal complex permits to obtain very good bleaching properties without damaging the textiles in comparison with the dinuclear manganese complex catalysts. It is also more environment friendly than those catalysts comprising cobalt or manganese.

Advantageously, the lanthanide metal complex enhances the bleaching effect of bleaches or detergent compositions which comprise a source of hydrogen peroxide, such as hydrogen peroxide, hydrogen peroxide liberating or hydrogen peroxide generating compounds.

The lanthanide metal complex enhances the bleaching effect of bleaches or detergent compositions especially for hydrophobic/lipophilic stains and also for hydrophilic/lipophobic stains, notably on textiles.

In context of the present invention, the term "bleaching" should be understood to relate generally to the decolourisation of stains or of other materials attached to or associated with a substrate. However, it is envisaged that the present invention can be applied where a requirement is the removal and/or neutralisation by an oxidative bleaching reaction of malodours or other undesirable components attached to or otherwise associated with a substrate. Furthermore, in the context of the present invention bleaching is to be understood as any bleaching mechanism or process that does not require the presence of light or activation by light.

The present invention further provides a method for treating, notably for bleaching, a substrate, comprising the step of contacting the substrate with the composition comprising:

a) a source of hydrogen peroxide; and b) a lanthanide metal complex comprising:

a metal selected from the group consisting of La, Ce, Pr, Nd, Pm, Sm, Eu, Gd, Tb, Dy, Ho, Er, Tm, Yb and Lu, and an aromatic compound as a ligand, wherein the aromatic compound comprises at least one electron withdrawing substituent and at least one nucleophilic group.

Other characteristics, details and advantages of the invention will emerge even more fully upon reading the description which follows.

Definitions

For convenience, before further description of the present disclosure, certain terms employed in the specification, and examples are collected here. These definitions should be read in the light of the remainder of the disclosure and understood as by a person of skill in the art. The terms used herein have the meanings recognized and known to those of skill in the art, however, for convenience and completeness, particular terms and their meanings are set forth below.

The articles "a", "an" and "the" are used to refer to one or to more than one (i.e., to at least one) of the grammatical object of the article.

The term "and/or" includes the meanings "and", "or" and also all the other possible combinations of the elements connected to this term.

As used herein, "weight percent," "wt %," "percent by weight," "% by weight," and variations thereof refer to the concentration of a substance as the weight of that substance divided by the total weight of the composition and multiplied by 100.

It should be noted that in specifying any range of concentration, weight ratio or amount, any particular upper concentration, weight ratio or amount can be associated with any particular lower concentration, weight ratio or amount, respectively.

The terms "comprise" and "comprising" are used in the inclusive, open sense, meaning that additional elements may be included. Throughout this specification, unless the context requires otherwise the word "comprise", and variations, such as "comprises" and "comprising", will be understood to imply the inclusion of a stated element or step or group of element or steps but not the exclusion of any other element or step or group of element or steps.

The term "including" is used to mean "including but not limited to". "Including" and "including but not limited to" are used interchangeably.

Ratios, concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited.

The term "between" should be understood as being inclusive of the limits.

It is specified that, in the continuation of the description, unless otherwise indicated, the values at the limits are included in the ranges of values which are given. It should be noted that in specifying any range of concentration, any particular upper concentration can be associated with any particular lower concentration.

DETAILED DESCRIPTION OF THE INVENTION

Lanthanide Metal Complex

Metal ions bind to ligands (both organic and inorganic) via interactions that are often strong and selective. The ligands impart their own functionality and can tune properties of the overall complex that are unique from those of the individual ligand or metal. The thermodynamic and kinetic properties of metal-ligand interactions influence ligand exchange reactions.

Metal-ligand complexes span a range of coordination geometries that give them unique shapes compared to organic molecules. The bond lengths, bond angles, and number of coordination sites can vary depending on the metal and its oxidation state. The lanthanide metal complex comprises a metal selected from the group consisting of La, Ce, Pr, Nd, Pm, Sm, Eu, Gd, Tb, Dy, Ho, Er, Tm, Yb and Lu. Preferably, the lanthanide metal is Ce, Pr or Nd and more preferably Ce.

The ligand can be an aromatic compound having at least one electron withdrawing substituent and at least one nucleophilic group. The aromatic compound may comprise at least one aromatic ring.

As used herein, "aromatic ring", also known as simple arene or simple aromatic, refers to aromatic organic compounds that consist only of a conjugated planar ring system. The aromatic rings can be heterocyclic if they contain non-carbon ring atoms, for example, oxygen, nitrogen, or sulfur. Preferred aromatic ring can be selected from pyridine, bipyridine, tripyridine, phenol, dihydroxybenzene, naphthol and dihydroxynaphthalene.

Preferably, the aromatic compound having at least one electron withdrawing substituent and at least one nucleophilic group contains a four, five, six or seven-membered aromatic ring. More preferably, it has a five or six-membered aromatic ring.

The number of the aromatic ring comprised in the aromatic compound having at least one electron withdrawing substituent and at least one nucleophilic group ranges from 1 to 5 and preferably from 1 to 3. In one preferred embodiment, the aromatic compound has 1 or 3 five-membered or six-membered aromatic ring.

It should be understood the electron withdrawing substituent is not particularly limited and can be —COOX, —$SO_3X$, —COOCl, —$CONH_2$, —CN, —Cl, —F, —Cl, —Br, —I, —CHO, —$NH_3^+$ or —$NO_2$. X is H or an alkali metal, which can be Li, Na or K. It is preferred the number of electron withdrawing substituent connected to aromatic ring ranges from 1 to 3.

It should be understood the nucleophilic group is not particularly limited. It can be heteroatoms, which are usually selected from O, N and S contained in the aromatic ring. It can also be a group connected to the aromatic ring, such as —OH, —SH or —NR' R", wherein R' and R" are independently hydrogen or a $C_1$-$C_{12}$ alkyl. Preferably, the number of nucleophilic group connected to aromatic ring ranges from 1 to 3 and more preferably 2.

In some embodiments, the aromatic compound has the general formula (I):

(I)

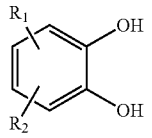

In some embodiments, the aromatic compound has the general formula (II):

(II)

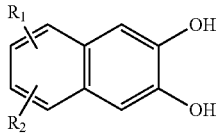

In some embodiments, the aromatic compound has the general formula (III):

(III)

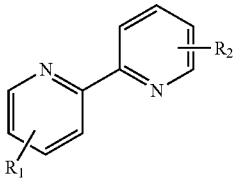

wherein $R_1$ is $SO_3X$ or COOX;

$R_2$ is H, methyl, $SO_3M$ or COOX;

X is H or an alkli metal;

M is an alkli metal.

The aromatic compound can be selected from tiron, sodium 2,5-dihydroxybenzenesulfonate, potassium 2,5-dihydroxybenzenesulfonate, 3,4-dihydroxybenzenesulfonic acid, sodium 6,7-dihydroxynaphthalene-2-sulfonate, di sodium 3-hydroxy-2,7-naphthalenedisulfonate, sodium 4-hydroxynaphthalene-1-sulfonate, sodium 6-hydroxy-2-naphthalenesulfonate, potassium 6-hydroxy-2-naphthalenesulfonate, 6,7-dihydroxynaphthalene-2-sulphonic acid, 4,6-dihydroxynaphthalene-2-sulphonic acid, 6-hydroxynaphthalene-2-sulfonic acid, 4-hydroxy-1-naphthalenesulfonic acid, 4-hydroxybenzoic acid, 3-hydroxybenzoic acid, sodium 3-hydroxybenzoate, sodium 4-hydroxybenzoate, potassium 4-hydroxybenzoate, potassium 2-hydroxybenzoate, lithium 4-hydroxybenzoate, sodium 2,4-dihydroxybenzoate, sodium 2,6-dihydroxybenzoate, sodium 2,3-dihydroxybenzoate, sodium 2,5-dihydroxybenzoate, potassium 3,4-dihydroxybenzoate, lithium 2,5-dihydroxybenz oate, 2,3-dihydroxybenzoic acid, 2,4-dihydroxybenzoic acid, 2,5-dihydroxybenzoic acid, 3,4-dihydroxybenzoic acid, 3,5-pyridinedicarboxylic acid, sodium 4-pyridinecarboxylate, sodium 2-pyridinecarboxylate, potassium 3-pyridinecarboxylate, 3,5-pyridinedicarboxylic acid, 2,6-pyridinedicarboxylic acid, 2,4-pyridinedicarboxylic acid, 2,3-pyridinedicarboxylic acid, di sodium 2,6-pyridinedicarboxylate, 3-pyridinecarboxylic acid, 4-pyridinecarboxylic acid, 2-pyridinecarboxylic acid, 2,2'-bipyridine-4-carboxylic acid, 2,2'-bipyridine-5,5'-dicarboxylic acid and 2,2'-bipyridine-4,4'-dicarboxylic acid.

Preferred aromatic compound can be selected from tiron, sodium 6,7-dihydroxynaphthalene-2-sulfonate, 2,3-dihydroxybenzoic acid, 3,4-dihydroxybenzoic acid and 2,2'-bipyridine-4,4'-dicarboxylic acid.

The lanthanide metal complex can be prepared by well-known methods, such as in-situ reactions taught by J. AM. CHEM. SOC. 2003, 125, 13324-13325 and CHEM. COMMUN., 2002, 2474-2475.

In a preferred embodiment, the lanthanide metal complex can be prepared by mixing the lanthanide metal salts with ligand in the presence of a solvent.

The composition may contain in an amount from 0.01-5.00% by weight of lanthanide metal complex calculated as lanthanide metal, preferably from 0.1-1.0% by weight, more preferably from 0.2-0.5% by weight, with respect to the total weight of the composition; notably 0.0001, 0.0005, 0.001, 0.005, 0.01, 0.05, 0.1, 0.5 and 1% by weight or any range comprised between these values.

Source of Hydrogen Peroxide

The source of hydrogen peroxide may be chosen from hydrogen peroxide, hydrogen peroxide liberating or hydrogen peroxide generating compounds.

The hydrogen peroxide liberating or generating compounds may be organic peroxides, such as hydroperoxides, peroxyacids, diacyl peroxides, dialkylperoxides, and their salts or precurors; or inorganic peroxide salts, such as the alkali metal perborates, alkali metal percarbonates, alkali metal perphosphates, alkali metal persulphates, and their precurors.

Mixtures of two or more such compounds may also be suitable. Particularly preferred are sodium percarbonate and sodium perborate and, especially, sodium perborate monohydrate. Sodium perborate monohydrate is preferred to tetrahydrate because of its excellent storage stability while also dissolving very quickly in aqueous bleaching solutions. Sodium percarbonate may be preferred for environmental reasons. These bleaching compounds may be utilized alone or in conjunction with a peroxyacid bleach precursor.

The peroxyacid may include monoperoxy acids and diperoxyacids.

Typical monoperoxy acids useful herein include, for example: peroxybenzoic acid and ring-substituted peroxybenzoic acids, eg peroxy-.alpha.-naphthoic acid; aliphatic, substituted aliphatic and arylalkyl monoperoxyacids, e.g. peroxylauric acid, peroxystearic acid and N,N-phthaloylaminoperoxy caproic acid (PAP); and 6-octylamino-6-oxoperoxyhexanoic acid.

Typical diperoxyacids useful herein include, for example: 1,12-diperoxydodecanedioic acid (DPDA), 1,9-diperoxyazelaic acid, diperoxybrassilic acid; diperoxysebasic acid and diperoxyisophthalic acid; 2-decyldiperoxybutane-1,4-diotic acid; and 4,4'-sulphonylbisperoxybenzoic acid.

Composition

In one aspect of the present invention, it relates to a composition comprising:

a) a source of hydrogen peroxide; and b) a lanthanide metal complex comprising:

- a metal selected from the group consisting of La, Ce, Pr, Nd, Pm, Sm, Eu, Gd, Tb, Dy, Ho, Er, Tm, Yb and Lu, and
- an aromatic compound as a ligand, wherein the aromatic compound comprises at least one electron withdrawing substituent and at least one nucleophilic group.

In particular, the composition, notably a bleaching composition can be formulated to contain, for example, from 0.1 to 70% by weight, preferably from 1 to 50% by weight, more preferably from 5 to 30% by weight of source of hydrogen peroxide, with respect to the total weight of the composition.

According to any one of the invention embodiments, the composition may comprise:

(a) from 0.1 to 70% by weight of the source of hydrogen peroxide, with respect to the total weight of the composition; and (b) from 0.01-5% by weight of the lanthanide metal complex calculated by lanthanide metal, with respect to the total weight of the composition.

Preferably, the composition may comprise:

(c) from 1 to 50% by weight of the source of hydrogen peroxide, with respect to the total weight of the composition; and (d) from 0.1-1% by weight of the lanthanide metal complex calculated by lanthanide metal, with respect to the total weight of the composition.

More preferably, the composition may comprise:

(e) from 0.01-5% by weight of the source of hydrogen peroxide, with respect to the total weight of the composition; and (f) from 0.2-0.5% by weight of the lanthanide metal complex calculated by lanthanide metal, with respect to the total weight of the composition.

The composition of the invention, notably the bleaching composition, may be formulated by combining effective amounts of the components.

The term "effective amounts" as used herein means that the ingredients are present in quantities such that each of them is operative for its intended purpose when the resulting mixture is combined with water to form an aqueous medium which can be used to wash and clean clothes, fabrics and other articles.

The composition of the invention may then further comprise water.

The pH of the composition may be from 7 to 12, preferably from 9 to 11.

The composition may further comprise a detergent. The detergents are usually defined as a surfactant or a mixture of surfactants having cleaning properties in dilute solutions. The lanthanide metal complex according to the invention is compatible with substantially any known and common surface-active agents and detergency builder materials. The surfactant may be naturally derived, such as soap, or a synthetic material selected from anionic, nonionic, amphoteric, zwitterionic, cationic actives and mixtures thereof. Many suitable actives are commercially available and are amply described in literature. The total level of the surfactant may range up to 50% by weight, preferably being from 1 to 40% by weight of the detergent composition, most preferably 2 to 25% by weight.

In general, the nonionic and anionic surfactants of the surfactant system may be chosen from the surfactants described "Surface Active Agents" Vol. 1, by Schwartz & Perry, Interscience 1949, Vol. 2 by Schwartz, Perry & Berch, Interscience 1958, in the current edition of "McCutcheon's Emulsifiers and Detergents" published by Manufacturing Confectioners Company or in "Tenside-Taschenbuch", H. Stache, 2$^{nd}$ Edn., Carl Hauser Verlag, 1981.

Examples of suitable synthetic anionic detergent compounds are sodium and ammonium alkyl sulphates, especially those obtained by sulphating higher ($C_8$-$C_{18}$) alcohols produced, for example, from tallow or coconut oil; sodium and ammonium alkyl ($C_9$-$C_{20}$) benzene sulphonates, particularly sodium linear secondary alkyl ($C_{10}$-$C_{15}$) benzene sulphonates; sodium alkyl glyceryl ether sulphates, especially those esters of the higher alcohols derived from tallow or coconut oil and synthetic alcohols derived from petroleum; sodium coconut oil fatty acid monoglyceride sulphates and sulphonates; sodium and ammonium salts of sulphuric acid esters of higher ($C_9$-$C_{18}$) fatty alcohol alkylene oxide, particularly ethylene oxide, reaction products; the reaction products of fatty acids such as coconut fatty acids esterified with isethionic acid and neutralized with sodium hydroxide; sodium and ammonium salts of fatty acid amides of methyl taurine; alkane monosulphonates such as those derived by reacting alpha-olefins ($C_8$-$C_{20}$) with sodium bisulphite and those derived by reacting paraffins with $SO_2$ and $C_{12}$ and then hydrolyzing with a base to produce a random sulphonate; sodium and ammonium $C_7$-$C_{12}$ dialkyl sulfosuccinates; and olefin sulphonates, which term is used to describe the material made by reacting olefins, particularly $C_{10}$-$C_{20}$ alpha olefins with $SO_3$ and then neutralizing and hydrolysing the reaction product. The preferred anionic detergent compounds are sodium ($C_{11}$-$C_{15}$) alkylbenzene sulphonates, sodium ($C_{16}$-$C_{18}$) alkyl sulphates and sodium ($C_{16}$-$C_{18}$) alkyl ether sulphates.

Examples of suitable nonionic surfactant compounds which may be used, include in particular the reaction products of alkylene oxides, usually ethylene oxide, with alkyl ($C_6$-$C_{22}$) phenols, generally 5-25 EO, i.e. 5-25 units of ethylene oxides per molecule; the condensation products of aliphatic ($C_8$-$C_{18}$) primary or secondary linear or branched alcohols with ethylene oxide, generally 3-30 EO, and products made by condensation of ethylene oxide with the reaction products of propylene oxide and ethylene diamine. Other so-called nonionic surfactants include alkyl polyglycosides, long chain tertiary amine oxides, long chain tertiary phosphine oxides and dialkyl sulphoxides.

Soaps may also be incorporated in the compositions of the invention, preferably at a level of less than 25% by weight. They are particularly useful at low levels in binary (soap/anionic) or ternary mixtures together with nonionic or mixed synthetic anionic and nonionic compounds. Soaps which are used, are preferably the sodium, or, less desirably, potassium salts of saturated or unsaturated $C_{10}$-$C_{24}$ fatty acids or mixtures thereof. The amount of such soaps can be varied between 0.5 and 25% by weight, with lower amounts of 0.5 to 5% by weight being generally sufficient for lather control. Amounts of soap between 2 and 20% by weight, especially between 5 and 10% by weight, are used to give a beneficial effect on detergency. This is particularly valuable in bleaching compositions used in hard water when the soap acts as a supplementary builder.

The detergent compositions of the invention will normally also contain a detergency builder. Builder materials may be selected from calcium sequestrant materials, precipitating materials, calcium ion-exchange materials, such as aluminosilicates, silicates, carbonates and phosphates.

Examples of suitable inorganic builders are aluminosilicates with ion-exchanging properties, such as zeolites. Various types of zeolites are suitable, especially zeolites A, X, B, P, MAP and HS in their Na form, or in forms in which Na is partly replaced by other cations, such as Li, K, Ca, Mg or ammonium. Suitable zeolites are described, for example, in EP-A 038 591, EP-A 021 491, EP-A 087 035, U.S. Pat. No. 4,604,224, GB-A2 013 259, EP-A 522 726, EP-A 384 070 and WO 94/24 251.

Other suitable inorganic builders are, for example, amorphous or crystalline silicates, such as amorphous disilicates, crystalline disilicates such as the sheet silicate SKS-6

(manufactured by Essential Ingredients, Inc.). The silicates can be employed in the form of their alkali metal, alkaline earth metal or ammonium salts. Na, Li and Mg silicates are preferably employed.

These builder materials may be present at a level of, for example, from 5 to 80% by weight, preferably from 10 to 60% by weight.

The composition may also contain one or more stabilizers. These comprise additives able to adsorb, bind or complex traces of heavy metals. Examples of additives which can be used according to the invention include but are not limited to: polyanionic compounds, such as polyphosphates, polycarboxylates, polyhydroxypolycarboxylates, soluble silicates as completely or partially neutralized alkali metal or alkaline earth metal salts, in particular as neutral Na or Mg salts, which are relatively weak bleach stabilizers. Examples of strong bleach stabilizers which can be used according to the invention are complexing agents such as ethylenediaminetetraacetate (EDTA), nitrilotriacetic acid (NTA), methylglycinediacetic acid (MGDA), [beta]-alaninediacetic acid (ADA), ethylenediamnine-N,N'-disuccinate (EDDS) and phosphonates such as ethylenediaminetetramethylenephosphonate, diethylenetriaminepentamethylenephosphonate or hydroxyethylidene-1,1-diphosphonic acid in the form of the acids or as partially or completely neutralized alkali metal salts. The complexing agents are preferably employed in the form of their Na salts.

Apart from the components already mentioned, the composition can contain any of the conventional additives in the amounts in which such materials are normally employed in fabric washing detergent compositions. Examples of these additives include leather boosters, such as alkanolamides, particularly the monoethanol amides derived from palmkernel fatty acids and coconut fatty acids, lather depressants, such as alkyl phosphates and silicones, anti-redeposition agents, such as sodium carboxymethyl cellulose and alkyl or substituted alkyl cellulose ethers, other stabilizers, such as ethylene diamine tetraacetic acid and the phosphonic acid derivatives, fabric softening agents, inorganic salts, such as sodium sulphate, and, usually present in very small amounts, fluorescent agents, perfumes, corrosion inhibitors, enzymes, such as proteases, cellulases, lipases, amylases and oxidases, germicides and colorants.

The composition may additionally comprise one or more enzymes, which provide cleaning performance, fabric care and/or sanitation benefits. Said enzymes include oxidoreductases, transferases, hydrolases, lyases, isomerases and ligases. Suitable members of these enzyme classes are described in Enzyme nomenclature 1992: recommendations of the Nomenclature Committee of the International Union of Biochemistry and Molecular Biology on the nomenclature and classification of enzymes, 1992, ISBN 0-12-227165-3, Academic Press.

The composition may be formulated as free-flowing particles, e.g. in powdered or granulated form. In such case, the composition can be prepared by any of the conventional techniques employed in the manufacture of detergent compositions, for instance by slurry-making, followed by spray-drying to form a detergent base powder to which the heat-sensitive ingredients can be added as dry substances.

It will be appreciated, however, that the composition can itself be made in a variety of other ways, such as the so-called part-part processing, non-tower route processing, dry-mixing, agglomeration, granulation, extrusion, compacting and densifying processes etc., such ways being well known to those skilled in the art.

Applications

The present invention further provides a method for cleaning, notably for bleaching, a substrate, comprising the step of contacting the substrate with a composition comprising:

a) a source of hydrogen peroxide; and b) a lanthanide metal complex comprising:

- a metal selected from the group consisting of La, Ce, Pr, Nd, Pm, Sm, Eu, Gd, Tb, Dy, Ho, Er, Tm, Yb and Lu, and
- an aromatic compound as a ligand, wherein the aromatic compound comprises at least one electron withdrawing substituent and at least one nucleophilic group.

The present invention also relates to a method for bleaching a substrate, comprising the step of contacting the substrate, in an aqueous medium, with the composition described herein.

The method of the present invention may be conducted at various temperatures, preferably at a temperature up to 90° C. and more preferably from 25 to 40° C.

Any suitable substrate that is susceptible to bleaching may be used, such as a textile. Preferably the textile is a laundry fabric or garment.

In a preferred embodiment, the method is carried out on a laundry fabric using aqueous treatment liquor. In particular, the treatment may be effected in a wash cycle for cleaning laundry. More preferably, the treatment is carried out in an aqueous detergent bleach wash liquid.

The organic substances can be contacted with the textile fabric in any conventional manner. For example it may be applied in dry form, such as in powder form, or in a liquor that is then dried, for example in an aqueous spray-on fabric treatment fluid or a wash liquor for laundry cleaning, or a non-aqueous dry cleaning fluid or spray-on aerosol fluid.

In a particularly preferred embodiment the method according to the present invention is carried out on a laundry fabric using aqueous treatment liquor. In particular the method may be effected in, or as an adjunct to, an essentially conventional wash cycle for cleaning laundry. More preferably, the method is carried out in an aqueous detergent wash liquor. The organic substance can be delivered into the wash liquor from a powder, granule, pellet, tablet, block, bar or other such solid form. The solid form can comprise a carrier, which can be particulate, sheet-like or comprise a three-dimensional object. The carrier can be dispersible or soluble in the wash liquor or may remain substantially intact. In other embodiments, the organic substance can be delivered into the wash liquor from a paste, gel or liquid concentrate.

In the alternative, the organic substance can be presented in the form of a wash additive that preferably is soluble. The additive can take any of the physical forms used for wash additives, including powder, granule, pellet, sheet, tablet, block, bar or other such solid form or take the form of a paste, gel or liquid. Dosage of the additive can be unitary or in a quantity determined by the user. While it is envisaged that such additives can be used in the main washing cycle, the use of them in the conditioning or drying cycle is not hereby excluded.

The present invention is not limited to those circumstances in which a washing machine is employed, but can be applied where washing is performed in some alternative vessel. In these circumstances it is envisaged that the organic substance can be delivered by means of slow release from the bowl, bucket or other vessel which is being employed, or from any implement which is being employed, such as a brush, bat or dolly, or from any suitable applicator.

The invention also concerns a method for removing cooked-, baked-, or burnt-on food soil (such as grease, meat, dairy, fruit, pasta and any other food especially difficult to remove after the cooking process) from cookware and tableware (including stainless steel, glass, plastic, wood and ceramic objects).

The method may comprise a step of contacting the cookware/tableware, notably in an automatic dishwashing machine, in the presence of a composition, notably a bleaching composition.

Thus, according to another aspect of the invention, the removal of cooked-, baked-, or burnt-on food soil from cookware and tableware can be carried out by the use of the compositions (wherein "the composition" is understood to comprise a source of hydrogen peroxide; a lanthanide metal complex and optional additional active ingredients and diluents) and one or more automatic dishwashing detergent compositions.

The composition can be built, unbuilt or generally unbuilt, but when used as an additive composition in conjunction with a dishwashing detergent composition, the composition will normally be relatively unbuilt by comparison with the detergent composition. By "relatively unbuilt" is meant that under normal use conditions, the solvent composition will deliver a minor proportion (less than 50%, preferably less than 25%, more preferably less than 10% by weight) of the total builder delivered to the wash liquor by the one or more compositions and the one or more detergent compositions. By "generally unbuilt" is meant that the composition contains less than about 5% by weight of detergency builder.

According to different embodiments of the present invention, the compositions and automatic dishwashing detergent compositions can be delivered either at the same or at different points of the dishwashing cycle, for example: i) the composition and automatic dishwashing detergent composition are independently delivered in the pre-wash cycle and in the main-wash cycle, respectively; ii) the composition and a first automatic dishwashing detergent composition are delivered in the pre-wash cycle and a second automatic dishwashing detergent composition in the main-wash cycle; iii) a first composition and a first automatic dishwashing detergent composition are delivered in the pre-wash cycle and a second composition and a second automatic dishwashing detergent composition in the main-wash cycle; iv) the composition and an automatic dishwashing detergent composition are delivered simultaneously in the main-wash cycle; and v) the composition and an automatic dishwashing detergent composition are delivered in the pre-wash and in the main-wash cycle.

Another embodiment provides a method of removing cooked-, baked-, or burnt-on food soil from cookware and tableware comprising washing the cookware/tableware in the pre-wash cycle of an automatic dishwashing machine in the presence of the composition and thereafter rinsing the cookware/tableware in the rinse cycle of the automatic dishwashing machine in the presence of an automatic dishwashing rinse composition.

The composition may also be applied in the peroxide oxidation of a broad range of organic molecules such as olefins, alcohols, aromatic ethers, sulphoxides and various dyes, and also for inhibiting dye transfer in the laundering of fabrics.

Furthermore, the composition can be applied for bleaching pulp, paper and other cellulose-based materials.

EXAMPLES

The compositions in the following samples were prepared and tested by using the material and procedure as described below:

Materials

- Hydrogen peroxide: CAS 7722-84-1; Sinoreagent
- Tetraacetylethylenediamine (TAED): CAS 10543-57-4; Alfa Aesar Chemical.
- Cerium (III) chloride heptahydrate: CAS 18618-55-8; Ourchem. Company
- Praseodymium chloride heptahydrate: CAS 10025-90-8; Ourchem. Company
- Neodymium chloride hexahydrate: CAS 13477-89-9; Ourchem. Company
- Disodium 4,5-dihydroxy-1,3-benzenedisulfonate monohydrate (tiron): CAS 270573-71-2; Sigma Aldrich.
- 2,2'-bispyridine-4,4'-dicarboxylic acid: CAS 6813-38-3; J&K chemical.
- Sodium 6,7-dihydroxynaphthalene-2-sulfonate: CAS 135-53-5; J&K chemical.
- Dragon complex: CAS 916075-10-0; Catexel Company.

Testing

The bleaching performance was evaluated by CIELAB Color i7 spectrophotometer. Color difference (ΔE) before and after bleaching is calculated with:

$$\Delta E = \sqrt{(l_{bleached} - l_{original})^2 + (a_{bleached} - a_{original})^2 + (b_{bleached} - b_{original})^2}$$

Example 1

1. Complex Preparation (Cerium-Tiron Complex) 41.6 mg of $CeCl_3.7H_2O$ and 148 mg of tiron (Ce/ligand=1:4 by mol) were weighed into the flask and 5 ml $H_2O$ was added. The mixture was stirred for 4 h and the complex was used without isolation. The formation of the complex was confirmed by the color of the solution from color less to slight pink.

2. Catalytic Laundry Bleaching

In the beaker containing 1 L water (250 mg/L Ca/Mg), the reference detergent (GB/T 13174-2008) (2.0 g) and 30% $H_2O_2$ (0.78 ml) were added consecutively. Then the prepared cerium complex solution was added and the whole mixture was stirred for 2 mins and the tea stained fabric pieces were added and kept stirring for 30 mins at 40° C. Finally, the bleached fabric was washed with 1 L tap water for 3 times, squeezed and dried naturally. The bleaching performance was measured with spectrophotometer (CIELAB Color i7) before and after bleaching and evaluated by the color difference ΔE.

Example 2

Complex preparation step was performed by the same way of example 1 with tiron replaced by 2,2'-Bispyridine-4,4'-dicarboxylic acid (Ce/Ligand=1:4 by mol). Catalytic laundry bleaching step was performed by the same way of example 1.

Example 3

Complex preparation step was performed by the same way of example 1 with tiron replaced by 3,4-Dihydroxybenzoic acid (Ce/Ligand=1:4 by mol).

Catalytic laundry bleaching step was performed by the same way of example 1.

Example 4

Complex preparation step was performed by the same way of example 1 with tiron replaced by 2,2'-Sodium 6,7-dihydroxynaphthalene-2-sulfonate (Ce/Ligand=1:4 by mol).

Catalytic laundry bleaching step was performed by the same way of example 1.

Example 5

Complex preparation step was performed by the same way of example 1 with 41.6 mg of $CeCl_3.7H_2O$ replaced by 42 mg of $NdCl_3.6H_2O$ (Nd/ligand=1:4 by mol). Catalytic laundry bleaching step was performed by the same way of example 1.

Example 6

Complex preparation step was performed by the same way of example 1 with 41.6 mg of $CeCl_3.7H_2O$ replaced by 42 mg of $PrCl_3.7H_2O$ (Pr/ligand=1:4 by mol). Catalytic laundry bleaching step was performed by the same way of example 1.

Comparative Example 1

The example was performed by the same way of example 1 without adding cerium complex and $H_2O_2$.

Comparative Example 2

The example was performed by the same way of example 1 without adding cerium complex.

Results of Ex. 1-6 and Ex. C1, C2 are shown in Table 1.

TABLE 1

| Ex. | Formulation | ΔE (C-H028) (Tea stained )[1] |
|---|---|---|
| 1 | Detergent (2.0 g); $H_2O_2$ 30% (0.78 ml); Cerium-Tiron complex | 19.7 |
| 2 | Detergent (2.0 g); $H_2O_2$ 30% (0.78 ml); Cerium-2,2'-bispyridine-4,4'-dicarboxylic acid complex | 20.1 |
| 3 | Detergent (2.0 g); $H_2O_2$ 30% (0.78 ml); Cerium-3,4-dihydroxybenzoic acid complex | 18.4 |
| 4 | Detergent (2.0 g); $H_2O_2$ 30% (0.78 ml); Cerium-2,2'-sodium 6,7-dihydroxynaphthalene-2-sulfonate complex | 17.4 |
| 5 | Detergent (2.0 g); $H_2O_2$ 30% (0.78 ml); Neodymium-Tiron complex | 18.6 |
| 6 | Detergent (2.0 g); $H_2O_2$ 30% (0.78 ml); Praseodymium-Tiron complex | 18.8 |
| C1 | Detergent (2.0 g) | 11.5 |
| C2 | Detergent (2.0 g); $H_2O_2$ 30% (0.78 ml) | 14.2 |

[1]Tea stained fabric reference: CFT B.V. C-H028 standard material Tea-Circular Stain Ø = 5 cm on Woven Cotton Obviously, the lanthanide metal complexes can enhance the bleaching effect of detergent composition.

Comparative Example 3

This example was performed by the same way of example 1 without adding the reference detergent.

Comparative Example 4

This example was performed by the same way of example 1 without adding the reference detergent and cerium complex.

Results of Ex. C3, C4 are shown in Table 2 below.

TABLE 2

| Ex. | Formulations | ΔE (Tea stained) |
|---|---|---|
| C3 | $H_2O_2$ 30% (0.78 ml), Cerium-tiron complex | 15.6 |
| C4 | $H_2O_2$ 30% (0.78 ml) | 11.9 |

It was shown that the composition of the invention permits to obtain higher bleaching properties on fabrics in comparison with the bleaching agent alone.

Example 7

The complex was produced by the same way of Example 1, the homemade tea/coffee mixed stained cotton fabric was washed in laundry machine (Haier XQBM20) (48 mins/each wash) for 4 cycles. The fabric was put inside the laundry machine, and then the formulation containing the reference detergent (GB/T 13174-2008) (2.0 g) and 30% $H_2O_2$ (0.78 ml) and the prepared cerium complex were added consecutively. The mode with 1 L water/48 mins was chosen for the wash cycle. After the wash procedure, the fabric was dried naturally and then was cut into 1 cm wide/10 cm length pieces for damage test. The peak force to cut at the middle of the washed fabric piece by a blunt metal bar was measured by a Newton meter.

Comparative Example 5

The test was performed by the same way of Example 7. But the corresponding formulation was only the reference detergent (GB/T 13174-2008) (2.0 g) instead of the formulation used in example 7.

Comparative Example 6

The test was performed by the same way of Example 7. But the corresponding formulation was a mixture of the reference detergent (GB/T 13174-2008) (2.0 g), $H_2O_2$ 30% (0.78 ml) and TAED (400 mg) instead of the formulation used in example 7.

Comparative Example 7

The test was performed by the same way of Example 7. But the corresponding formulation was a mixture of the reference detergent (GB/T 13174-2008) (2.0 g), $H_2O_2$ 30% (0.78 ml) and dragron complex (5 mg) instead of the formulation used in example 7.

Results of Ex. 7 and Ex. C5-C7 are shown in Table 3 below.

TABLE 3

| Ex. | Formulation | Peak Force to cut the fabric/N[1] | Standard deviation |
|---|---|---|---|
| 7 | Detergent (2.0 g); $H_2O_2$ 30% (0.78 ml); Cerium-Tiron complex | 53.75 | 3.28 |
| C5 | Detergent (2.0 g) | 51.76 | 2.28 |

TABLE 3-continued

| Ex. | Formulation | Peak Force to cut the fabric/N[1] | Standard deviation |
|---|---|---|---|
| C6 | Detergent (2.0 g), $H_2O_2$ 30% (0.78 ml), TAED(400 mg) | 53.66 | 5.21 |
| C7 | Detergent (2.0 g), $H_2O_2$ 30% (0.78 ml), dragon complex(5 mg) | 48.57 | 4.02 |

[1]Measured on Newtonmeter (Imada).

It is obvious that, the fabric damage caused by cerium complex is similar with TAED, while both of them cause much less damage than the dragon complex.

The invention claimed is:

1. A composition comprising-:

a) a source of hydrogen peroxide; and b) a lanthanide metal complex comprising-:

a metal selected from the group consisting of La, Ce, Pr, Nd, Pm, Sm, Eu, Gd, Tb, Dy, Ho, Er, Tm, Yb and Lu, and an aromatic compound as a ligand, wherein the aromatic compound has general formula (I), (II), or (III):

(I)

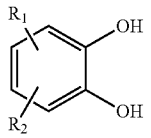

(II)

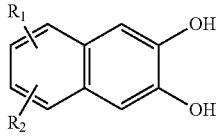

(III)

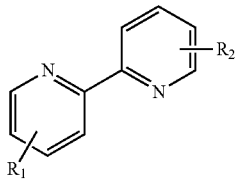

wherein:

$R_1$ is $SO_3X$ or COOX;

$R_2$ is H, methyl, $SO_3M$ or COOX;

X is H or an alkli metal; and

M is an alkli metal.

2. The composition according to claim 1, wherein the metal is selected from Ce, Pr and Nd.

3. The composition according to claim 1, wherein the alkali metal is selected from Li, Na and K.

4. The composition according to claim 1, wherein the aromatic compound is selected from the group consisting of compounds of tiron, 3,4-dihydroxybenzenesulfonic acid, sodium 6,7-dihydroxynaphthalene-2-sulfonate, sodium 2,3-dihydroxybenzoate, potassium 3,4-dihydroxbenzoate, 2,3-dihydroxybenzoic acid, 3,4-dihydroxybenzoic acid, 2,2'-bipyridine-4-carboxylic acid, 2,2'-bipyridine-5,5'-dicarboxylic acid and 2,2'-bipyridine-4,4'-dicarboxylic acid.

5. The composition according to claim 4, wherein the aromatic compound is selected from the group consisting of compounds of tiron, sodium 6,7-dihydroxynaphthalene-2-sulfonate, 2,3-dihydroxybenzoic acid, 3,4-dihydroxybenzoic acid and 2,2'-bipyridine-4,4'-dicarboxylic acid.

6. The composition according to claim 1, wherein the source of hydrogen peroxide is selected from the group consisting of hydrogen peroxide, inorganic peroxide salts, organic peroxides, and mixtures thereof.

7. The composition according to claim 6, wherein the source of hydrogen peroxide is hydrogen peroxide.

8. The composition according to claim 1, wherein the composition comprises:

(a) from 0.1 to 70% by weight of the source of hydrogen peroxide, with respect to the total weight of the composition; and (b) from 0.01-5% by weight of the lanthanide metal complex calculated by lanthanide metal, with respect to the total weight of the composition.

9. The composition according to claim 8, wherein the composition comprises:

(c) from 1 to 50% by weight of the source of hydrogen peroxide, with respect to the total weight of the composition; and (d) from 0.1-1% by weight of the lanthanide metal complex calculated by lanthanide metal, with respect to the total weight of the composition.

10. The composition according to claim 1, wherein the composition comprises:

(e) from 0.01-5% by weight of the source of hydrogen peroxide, with respect to the total weight of the composition; and (f) from 0.2-0.5% by weight of the lanthanide metal complex calculated by lanthanide metal, with respect to the total weight of the composition.

11. The composition according to claim 1, wherein the composition further comprises a detergent.

12. The composition according to claim 1, wherein the composition further comprises water.

13. A method for treating a substrate, comprising the step of contacting the substrate with the composition according to claim 1.

14. The method according to claim 13, wherein the substrate is a textile, a pulp or a paper.

15. A method for removing cooked-, baked-, or burnt-on food soil from cookware or tableware, the method comprising a step of contacting the cookware tableware with a composition according to claim 1.

* * * * *